US005361978A

United States Patent [19]

Monroe

[11] Patent Number: 5,361,978

[45] Date of Patent: Nov. 8, 1994

[54] WASTE RECEPTACLE

[76] Inventor: Thomas L. Monroe, 61 Ponderosa La., Palmyra, Va. 22963

[21] Appl. No.: 5,615

[22] Filed: Jan. 19, 1993

[51] Int. Cl.[5] ..... B65D 91/00

[52] U.S. Cl. ..... 232/43.1; 220/908; 280/763.1; 280/47.371

[58] Field of Search ..... 232/43.1, 43.5, 43.3; 220/908; 280/763.1, 47.33, 43.371; 188/5

[56] References Cited

U.S. PATENT DOCUMENTS

| | | | |
|---|---|---|---|
| 569,990 | 10/1896 | Arrick | 232/43.1 |
| 1,014,475 | 1/1912 | Holloway . | |
| 1,117,544 | 11/1914 | Barash | 232/43.1 |
| 1,213,588 | 1/1917 | Cohen | 220/980 |
| 1,360,569 | 11/1920 | Orr . | |
| 1,658,880 | 2/1928 | Brunetti | 232/43.1 |
| 3,495,850 | 2/1970 | Ziskal | 280/763.1 |
| 3,613,566 | 10/1971 | Shapleigh, Jr. . | |
| 3,869,979 | 3/1975 | Sulcek | 220/908 |
| 4,077,645 | 3/1978 | Dortch | 280/763.1 |
| 4,923,080 | 5/1990 | Lounsbury . | |
| 4,953,744 | 9/1990 | Koyama . | |
| 5,090,724 | 2/1992 | Fiore | 280/763.1 |
| 5,090,785 | 2/1992 | Stamp . | |

FOREIGN PATENT DOCUMENTS

| | | | |
|---|---|---|---|
| 1277367 | 10/1960 | France | 232/43.1 |
| 1469290 | 2/1967 | France | 220/908 |
| 2234559 | 7/1972 | Germany | 220/908 |
| 132288 | 7/1951 | Sweden | 232/43.5 |
| 1052678 | 12/1966 | United Kingdom | 220/908 |

*Primary Examiner*—Flemming Saether
*Attorney, Agent, or Firm*—Wigman, Cohen, Leitner & Myers

[57] ABSTRACT

A waste receptacle is supported on wheels or casters and in turn supports three orthogonal upright walls forming an interior trash receiving space. A trash receiving member comprises a first wall which serves as a receptacle side wall in a trash receiving state. A trash supporting wall extends from an edge of the first wall at an acute angle to form an inclined, trash-supporting bottom wall in the receptacle in the trash receiving state. A handle is secured to an upper portion of the first wall for manually pulling the first wall down to a substantially horizontal trash removal state about a pivot axis. In this state, the end wall is shifted to overhang the first wall and shifts the trash bag onto the first wall external the interior volume of the upright walls. The inclined end wall shifts the center of gravity of the filled trash bag toward the pivot axis to facilitate pivoting of the trash receiving member. A stabilizing bar selectively secures the wheeled receptacle in place during trash removal.

18 Claims, 1 Drawing Sheet

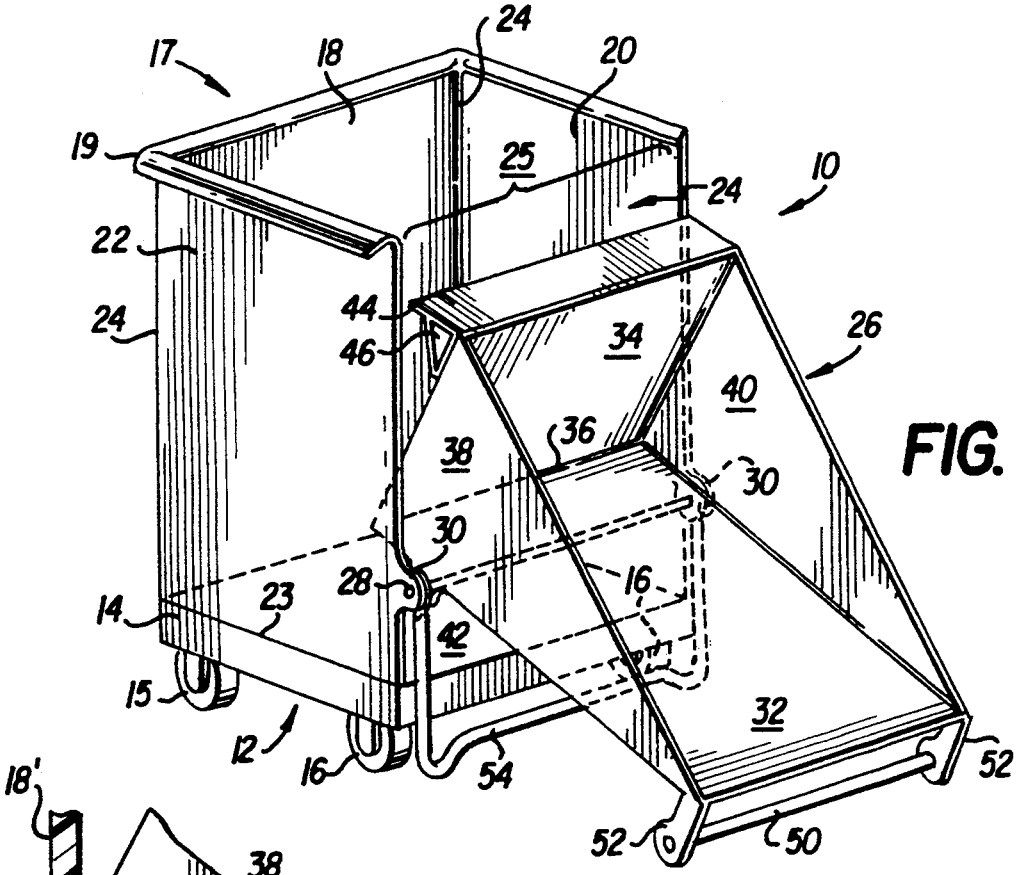
FIG. 1
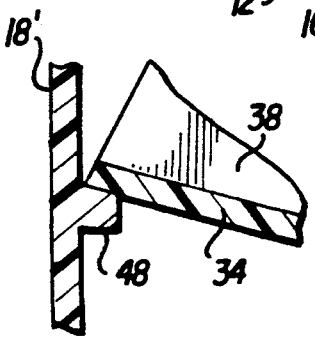
FIG. 3
FIG. 4
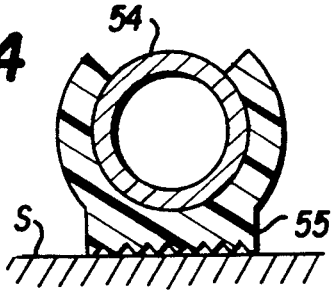
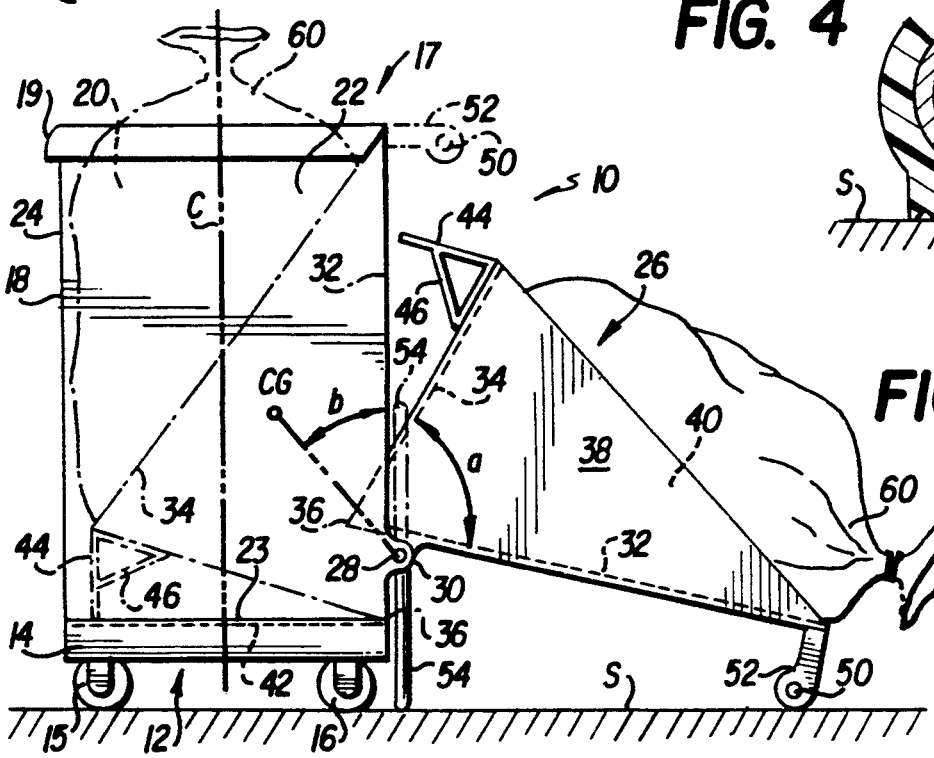
FIG. 2

WASTE RECEPTACLE

FIELD OF THE INVENTION

The present invention relates to waste receptacles, and more particularly, to a waste receptacle for receiving disposable trash bags which may be easily removed from the receptacle without the necessity of lifting the bag after it has been filled with trash.

BACKGROUND OF THE INVENTION

In the commercial building maintenance and cleaning industry, relatively large waste receptacles are used by maintenance and janitorial personnel in handling the large amounts of waste and trash generated in commercial buildings. Typically, such receptacles are wheel-mounted so as to be movable from space-to-space or floor-to-floor throughout a commercial building, or other building structure to be maintained. Often such wheeled waste receptacles are merely large circular or rectangular containers having a volume in the range of 50–60 gallons which are provided with a replaceable paper or plastic trash bag or liner. Typically, when the bag or liner is filled, it must be lifted vertically from the receptacle which sometimes result in back strain or injury to the maintenance worker.

This problem has been addressed to some extent by prior art waste receptacles in which the bag can be removed from the receptacle without lifting the bag. For example, in U.S. Pat. No. 4,923,080, a trash receptacle is disclosed with a movable interior floor in which, in response to actuation of a foot pedal, the floor inclines to facilitate removing the filled trash bag. However, this arrangement still requires the bag to be manually pulled from the receptacle interior notwithstanding that this task is made easier by inclining the floor. Further, the movement of the floor occurs after the bag is filled, and if the bag is heavy, it may be somewhat difficult to shift the floor to the inclined position.

U.S. Pat. No. 4,953,744 is somewhat similar to the aforesaid '080 patent in that it discloses a trash receptacle with a fixed inclined bottom ramp. The ramp inclination is in a direction to cause the filled bag to slide out the front of the receptacle when a pair of front doors are opened. U.S. Pat. No. 3,613,566 discloses a kitchen-installed refuse compactor having a flat-bottomed drawer which receives a bag for containing refuse. The drawer arrangement includes a sidewall which swings relative to the opened drawer to permit lateral withdrawal of the refuse filled-bag. This is to alleviate the problem created by the compactor in wedging the compacted material in the limited space of the drawer or by the bag sticking to the walls of the compactor drawer.

U.S. Pat. No. 1,360,569 discloses a fence-mounted tiltable garbage receptacle. A rod is connected to a plate at the bottom of the receptacle and is used to remove the contents of the tilted receptacle.

It would be desirable to provide a waste receptacle which is used with trash bags and from which a heavy, trash-filled bag may be removed easily and quickly without manual lifting of the bag, and which may be placed at a desired trash pickup location without such lifting.

SUMMARY OF THE INVENTION

A waste receptacle according to the present invention for use with a trash receiving bag comprises a housing forming a trash-receiving space, and including at least one side wall, the housing having an opening through which trash may be deposited into the space. A trash receiving basket member is pivotally secured to the housing along a pivot axis and has first and second walls, the first wall forming an inclined bottom wall of the space and the second wall forming the one side wall of the housing. The basket member has a first, trash receiving position in which the basket member is upright and the bag rests on the inclined bottom wall of the member and a second trash removal position in which the basket member is pivoted to a generally horizontal position and the trash bag rests on the second wall of the basket member comprising the one side wall of the housing. The basket member is pivoted about the pivot axis from the first position to the second position so that the trash bag is displaced to a location external of the space onto the second wall from the first bottom wall during the pivoting of the basket member. The inclination of the first bottom wall is such that the center of gravity of the filled trash bag is shifted toward the pivot axis and toward the second wall in the trash receiving position thereby reducing the force necessary to pivot the basket member.

The housing is preferably wheel-mounted so as to be movable over a support surface such as the floors of a building. A stabilizer is pivotally mounted to the housing so as to be pivoted into engagement with the support surface and prevent the receptacle from tilting or moving on its wheels when the basket member is pivoted from its first, trash receiving position to its second, trash removal position. Advantageously, the stabilizer is provided with a rubber foot or sleeve for engaging and gripping the support surface in a non-slip manner.

With the foregoing and other advantages and features of the invention that will become hereinafter apparent, the nature of the invention may be more clearly understood by reference to the following detailed description of the invention, the appended claims and to the several views illustrated in the drawings.

BRIEF DESCRIPTION OF THE DRAWINGS

FIG. 1 is an isometric view of a waste receptacle according to one embodiment of the present invention;

FIG. 2 is a side elevation view of the receptacle of FIG. 1;

FIG. 3 is a fragmented side sectional view of a receptacle according to a second embodiment of the invention; and FIG. 4 is a transverse cross-sectional view of an alternate embodiment of a stabilizer bar.

DETAILED DESCRIPTION OF THE INVENTION

Referring now in detail to the drawings wherein like parts are designated by like reference numerals throughout, a waste receptacle 10 comprises a dolly 12 including a base or platform 14 and a set of casters or wheels 16. Platform 14 preferably is a molded thermoplastic material. Upstanding from platform 14 is a housing 17 comprising three walls 18, 20 and 22. The wall 18 forms a front wall and walls 20 and 22 are preferably identical side walls integrally formed with the front wall 18 at vertical corners 24. The walls may have an upper, outwardly curved lip 19 which extends continuously around the upper edges of the three walls. Walls 18, 20 and 22 may be made of any suitable material such as metal, but are preferably molded thermoplastic material and may be molded integrally with the platform 14 which forms the bottom wall of the housing.

The dolly 12 is optional, but is preferred for the purpose of mobility in the environment contemplated for the invention. If mobility is not a factor, then the dolly 12 may be eliminated and the walls 18, 20 and 22 may rest directly on a floor or other support surface via their lowermost edges 23. In such case, the housing 17 formed by the walls 18, 20 and 22 need not but may have a bottom wall. The walls 18, 20 and 22 enclose a space 24 having the shape of a rectangular polyhedron one surface of which comprises a rear rectangular opening 25.

A trash bag-carrying bin or basket member 26 is pivotally secured to the housing 17 via an axle 28 journalled in lugs 30 protruding from the rear edges of side walls 20 and 22. The basket member 26 comprises a planar rectangular wall 32 which forms the rear wall of the housing 17 and includes lugs or journal blocks (not shown) similar to lugs 30 in which the axle 28 is journalled so as to pivotally mount the member 26 to the housing 17. An end or bottom wall 34 extends from edge 36 of wall 32 at an acute angle a. Angle a is preferably about 65° but may be greater or smaller according to a given implementation of the invention. A pair of like triangular side walls 38 extend between the opposite longitudinal edges of the wall 32 and bottom wall 34 to form a space 40 having the shape of a triangular polyhedron.

The axle 28 is spaced from edge 36 a distance corresponding to the vertical distance between the axle 28 axis of rotation and the upper surface 42 of the platform 14. Thus, edge 36 is at the lowermost right hand corner in FIG. 2 when the basket member 26 is in the upright or vertical position as shown in dashed lines in FIG. 2. The terms vertical and horizontal herein refer to orientations relative to the force of gravity.

Basket member 26 also includes a load support plate 44 which may be braced with a rib or ribs 46. When the basket member 26 is vertical as shown in dashed lines in FIG. 2, the support plate 44 rests on surface 42 of platform 14 thus supporting the basket member 26 in the trash receiving position shown in dashed lines in FIG. 2. In the alternative, plate 44 and rib 46 may be replaced by a shoulder 48 (FIG. 3) which may extend from front wall 18' of the housing horizontally for supporting wall 34 of the basket member 26 in the trash receiving position. In this orientation, wall 34 is inclined about 25° to the horizontal and slopes downwardly toward the lowermost edge 36 of the vertical wall 32. Because of the angle a, the wall 34 overhangs cantilevered above wall 32 in the trash removal position of the basket member 26 as shown in FIG. 2 and in solid lines in FIG. 1.

A handle means comprising a rod 50 is secured to basket member 26 by end brackets 52 secured to wall 32 at the upper end thereof opposite edge 36. The handle is used to push the receptacle 10 along on front and rear wheels 15, 16, respectively, and to pivot the basket member 26 to the trash removal position. The brackets 52 are elongated and serve to support basket member 26 from the support surface S when it is pivoted to the trash removal position as shown in FIGS. 1 and 2.

A stabilizer bar 54 is pivotably mounted to axle 28 between lugs 30 and either side 38 of the basket member 26. Bar 54 is detented to lugs 30 so as to have a stowed position shown in solid lines in FIG. 2 or a stabilizing or operative position as shown in dashed lines in FIG. 2 and solid lines in FIG. 1. In the operative position, stabilizer bar 54 is engagable with the support surface S so as to prevent the waste receptacle 10 from tilting or from rolling along the support surface when the handle rod 50 is grasped and pulled to pivot the basket member 26 about axle 28 to the trash removal position. Preferably, the stabilizer bar 54 is dimensioned so that when it is in the operative position shown in dashed lines in FIG. 2 the rear wheels 16 are raised above the support surface S a slight distance, e.g., one-eighth inch.

As shown in FIG. 4, the stabilizer bar 54 may be provided with a rubber foot or feet 55 for engaging and gripping the support surface S in a non-slip manner. Feet 55 may be of molded rubber construction with a C-shaped portion for grippingly engaging over the stabilizer bar 54 as shown in FIG. 4.

A disposable trash bag 60 (FIG. 2) is placed in space 24 and rests on bottom wall 34 in the trash receiving position of the basket 26 shown in dashed lines. When the bag 60 is filled with trash via the open top of housing 17, the center of gravity (CG) of the bag is located above the pivot axis of shaft 28 and is shifted rearwardly toward the upright wall 32 because of the inclination of wall 34. This shift in the center of gravity of the trash toward the pivot axis of shaft 28 advantageously reduces the force necessary to pivot the basket member 26 to the trash removal position in the following manner.

The shifting of the center of gravity (CG) of the bag 60 toward the axis of shaft 28 shortens the moment arm between the CG and the pivot axis thereby increasing the mechanical advantage of the moment arm between the handle rod 50 and the pivot axis. The shifting of the CG toward the pivot axis also means that the CG will be raised a lesser distance during pivoting and will be vertically aligned with the pivot axis when the basket member 26 is pivoted through a lesser angle b than it would be if the CG were located along the vertical axis c of the space 24.

The waste receptacle 10 is operated as follows. When the bag 60 is filled, its opening is tied shut. The receptacle 10 is then rolled to a convenient trash pickup location. The stabilizer bar 54 is then rotated or pivoted to the position of FIG. 1 (dashed lines of FIG. 2) to insure that the receptacle does not roll or tilt during the trash unloading step. The handle rod 50 is then grasped and pulled rearwardly to pivot the basket member 26 about the axis of axle 28 to the position shown in FIG. 1 and in solid lines in FIG. 2. As shown in FIG. 2, as the wall 32 is lowered to an approximately horizontal orientation, the weight of the trash-filled bag 60 is automatically shifted off the bottom wall 34 onto wall 32. The angular relation of bottom wall 34 to wall 32 insures this action occurs, i.e., wall 34 overhangs wall 32 in this orientation so the trash bag 60 must shift onto the wall 32.

The center of gravity of the trash bag 60 is lifted only slightly during rotation of the basket member 26 and once past its high point during the rotation, the mass of the trash bag assists in further rotation of the basket member 26. The slight lifting of the CG is inconsequential due to the relatively high torque advantage of the system, i.e., the relatively longer moment arm between the handle 50 and the axle 28 as compared to the substantially shorter moment arm between the CG of the filled trash bag and the axle 28. Moreover, the mere act of rotating the basket member 26 automatically empties the bag 60 out of the interior space 24 into position on wall 32 for easy removal. Advantageously, the wall 32 is canted downwardly toward the support surface S in the trash removal position permitting the bag 60 to be easily slid off wall 32 and placed at the desired location. Thus, the filled bag can be easily emptied from the receptacle 10 without significant lifting of the bag.

Preferably, the housing 17 and basket member 26 are molded thermoplastic. However, other materials may be used in the alternative, including welded sheet metal and other materials and fastening arrangements. Should the space 24 be curved rather than rectilinear as shown, the wall 32 may be planar or curved. Preferably, end wall 34 is planar regardless the shape of the housing 17. The triangular side walls 38 of the basket member serve to contain the trash bag 60 on wall 32 as the bag is shifted from its position inside the space 24 to its external position shown.

Although certain presently preferred embodiments of the invention have been described herein, it will be apparent to those skilled in the art to which the invention pertains that variations and modifications of the described embodiments may be made without departing from the spirit and scope of the invention. Accordingly it is intended that the invention be limited only to the extent required by the appended claims and the applicable rules of law.

What is claimed is:

1. A waste receptacle for use with a trash receiving bag comprising:

a housing including at least one side wall forming a trash receiving space, said housing having an opening through which trash is deposited into said space; and a trash receiving member pivotally secured to said housing along a pivot axis, said member having a trash receiving position in which said trash bag rests upon said member and a trash removal position, said member having first and second walls, the first wall forming an inclined bottom wall of said space and the second wall forming a side wall of said space in the trash receiving position, said second wall connected to said first wall at an acute angle, said first and second walls being arranged to pivot about said pivot axis so that said trash bag is displaced from the first wall so as to rest on said second wall during the pivoting of said member to the trash removal position, the inclination of the first wall being arranged such that the center of gravity of a filled trash bag is shifted toward said pivot axis and toward said second wall in the trash receiving position.

2. The receptacle of claim 1, including means for pivotally securing the member to the housing so that the second wall is in a vertical orientation in said trash receiving position and is pivotable so that it is transverse to the vertical orientation in the trash removal position, said second wall having an end, said first wall being secured to the second wall end at an acute angle.

3. The receptacle of claim 1, wherein said housing includes a base, said receptacle including means coupled to said housing for supporting said first wall including a support member connected to and depending from said first wall and adapted to rest on said base in the trash receiving position.

4. The receptacle of claim 1, wherein said member includes a pair of spaced side walls respectively extending between said first and second walls.

5. The receptacle of claim 4, wherein each of said spaced side walls has a triangular shape with a first edge thereof being secured to the first wall and a second edge thereof being secured to the second wall.

6. The receptacle of claim 1, including means for movably supporting the housing on a floor, said receptacle including a stabilizer secured to said housing for selectively precluding displacement of the housing during positioning of said trash receiving member to the trash removal position.

7. The receptacle of claim 6, wherein said stabilizer is pivotally secured to said housing between a stowed position and a stabilizing position.

8. The receptacle of claim 6, wherein said movably supporting means comprises wheel means secured to said housing for permitting the housing to roll on a floor, said stabilizer including means for gripping the floor in a non-slip manner.

9. The receptacle of claim 1, including a handle secured to said second wall spaced from said first wall and arranged to support said second wall in the trash removal position.

10. A waste receptacle for use with a trash receiving bar comprising:

a housing including at least one side wall forming a trash receiving space, said housing having an opening through which trash is deposited into said space;

a trash receiving member pivotally secured to said housing along a pivot axis, said member having a trash receiving position in which said trash bag rests upon said member and a trash removal position, said member having first and second walls, the first wall forming an inclined bottom wall of said space and the second wall forming a side wall of said space in the trash receiving position, said second wall connected to said first wall at an acute angle, said first and second walls being arranged to pivot about said pivot axis so that said trash bag is displaced from the first wall so as to rest on said second wall during the pivoting of said member to the trash removal position, the inclination of the first wall being arranged such that the center of gravity of a filled trash bag is shifted toward said pivot axis and toward said second wall in the trash receiving position;

means for movably supporting the housing on a floor; and a stabilizer secured to said housing for selectively precluding displacement of the housing during positioning of said trash receiving member to the trash removal position, said stabilizer being pivotable about the pivot axis of the trash receiving member between a stowed position and a stabilizing position.

11. A waste receptacle for use with a trash receiving bag comprising:

a base;

at least one side wall upstanding from the base forming an interior space with said base, said space having an open rear region and a front region formed by said at least one side wall;

a plurality of wheels mounted to said base for rollably supporting said receptacle on a floor; and a trash receiving member pivotally secured to said at least one side wall along a pivot axis for enclosing said open rear region and closing said interior space in a trash receiving position and for opening said rear region in a trash removal position, said member comprising a door and a bottom connected along an edge thereof to the door at an acute angle and being adapted to support a trash bag, said bottom being arranged to slope downwardly from said front region toward the rear region and toward said door in the trash receiving position and overhanging said door in the trash removal position such that a filled trash bag supported by said bottom is shifted onto said door.

12. The receptacle of claim 11, wherein said door and bottom are planar and subtend an acute angle between the planes thereof.

13. The receptacle of claim 12, including a stabilizer pivotally secured to said at least one side wall along said pivot axis for selectively frictionally engaging said floor to preclude movement of said receptacle.

14. A waste receptacle for use with a trash receiving bag comprising:

a base;

wheel means supported on said base for rollably supporting said receptacle on a floor;

a housing supported on said base and enclosing a space for containing said trash receiving bag, said housing having a first opening through which trash is deposited into said bag, said housing having a side wall with a second opening therein, a basket member pivotally mounted in said second opening along a pivot axis and enclosing said space in a trash receiving position, said basket member comprising a first wall forming a portion of the side wall of the housing and a second wall connected to said first wall at an acute angle so as to be inclined with respect to said base, said trash receiving bag being supported upon said second wall in the trash receiving position such that the center of gravity of a filled trash receiving bag is shifted toward said pivot axis and said first wall, said basket member being pivotable about said pivot axis to a trash removal position such that said trash receiving bag is supported on said first wall; and a stabilizer pivotally mounted to said housing adjacent said pivot axis and being pivotable from a stowed position to a stabilizing position engaging the floor to prevent movement of the receptacle on said wheel means.

15. The receptacle of claim 14, including a handle mounted to the first wall for pivoting the basket member about said pivot axis.

16. The receptacle of claim 14, wherein said basket member further comprises a pair of triangular side walls connecting said first and second walls along respective side edges thereof.

17. The receptacle of claim 14, wherein the side wall of said housing comprises three rectangular panels mounted at right angles to each other, said first wall comprising a fourth rectangular panel disposed in said second opening in the trash receiving position of the basket member.

18. The receptacle of claim 14, wherein said housing and basket member are formed of a molded thermoplastic material.

* * * * *